United States Patent [19]

Overfield

[11] Patent Number: 4,618,413

[45] Date of Patent: Oct. 21, 1986

[54] METHOD FOR EXTRACTING NICKEL AND VANADIUM COMPOUNDS FROM OILS

[75] Inventor: Robert E. Overfield, Washington, N.J.

[73] Assignee: Exxon Research and Engineering Company, Florham Park, N.J.

[21] Appl. No.: 755,089

[22] Filed: Jul. 15, 1985

[51] Int. Cl.[4] ..... C10G 17/00; C10C 3/00

[52] U.S. Cl. ..... 208/251 R; 208/309

[58] Field of Search ..... 208/251 R, 309

[56] References Cited

U.S. PATENT DOCUMENTS

| | | | |
|---|---|---|---|
| 2,587,643 | 3/1952 | Myers | 208/309 |
| 2,846,358 | 8/1958 | Bieber et al. | 208/251 R |
| 2,882,219 | 4/1959 | Johnson | 208/309 |
| 2,913,394 | 11/1959 | Kimberlin, Jr. et al. | 208/87 |
| 3,018,228 | 1/1962 | Cornell | 585/864 |
| 3,511,774 | 5/1970 | Long et al. | 208/251 R |
| 3,779,902 | 12/1973 | Mitchell et al. | 208/309 |
| 3,798,157 | 3/1974 | Manzanilla et al. | 208/251 R |
| 3,912,801 | 10/1975 | Stephens | 423/24 |
| 4,348,314 | 9/1982 | Lazarus et al. | 525/439 |

OTHER PUBLICATIONS

C. Hansen & A. Beerhower, Kirk-Othmer Enc. of Chemical Technology, 2nd ed., suppl. pp. 889–910.

*Primary Examiner*—Andrew H. Metz
*Assistant Examiner*—Helane Myers
*Attorney, Agent, or Firm*—E. Thomas Wheelock

[57] ABSTRACT

This invention is a process for removing nickel and vanadium metalloporphyrinic compounds from oils which contain them. The process involves the extraction of those compounds using certain solvents which are not miscible with the oils involved and which are defined using variables known as three-dimensional solubility parameters. The most preferred solvents which meet the disclosed criteria are ethylene carbonate, propylene carbonate, ethylene trithiocarbonate and dimethylsulfone. The solvents are particularly useful in removing the nickel and vanadium compounds from heavier oils such as crude oils and the so-called gas oils obtained during the early stages of the refining process.

10 Claims, No Drawings

METHOD FOR EXTRACTING NICKEL AND VANADIUM COMPOUNDS FROM OILS

FIELD OF THE INVENTION

This invention is a process for removing nickel and vanadium metalloporphyrinic compounds from oils which contain them. The process involves the extraction of those compounds using certain solvents which are not miscible with the oils involved and which are defined using variables known as three-dimensional solubility parameters. The most preferred solvents which meet the disclosed criteria are ethylene carbonate, propylene carbonate, ethylene trithiocarbonate and dimethylsulfone. The solvents are particularly useful in removing the nickel and vanadium compounds from heavier oils such as crude oils and the so-called gas oils such as vacuum gas oils and deasphalted oils.

BACKGROUND OF THE INVENTION

When broken down to the basics, a modern refinery has the overall function of taking a naturally-occurring material—crude oil—and creating a multitude of other more directly useful products such as gasoline, kerosene, lubricating oils and the like. The refinery accomplishes its purpose by two major operations: separation of hydrocarbons and by conversion of hydrocarbons.

The separations may merely remove one particular kind of hydrocarbon from a mixture; for instance, kerosene is simply distilled from crude oil. Or the separation may remove an undesirable material from other useful materials; for instance (as in the current invention), a metal-containing compound may be separated from other oils.

The other generic function of the refinery is the conversion of hydrocarbons. This may entail changing the type of or the molecular weight of the oil. For instance, the catalytic reforming process begins with a hydrocarbon feedstock which is largely made up of straight-chain oil molecules (e.g., alkanes such as hexane) and converts them into materials which are closed chains (e.g., aromatics such as benzene or xylene). Aromatics tend to make higher-octane gasolines than the reformer feedstocks. Alternatively, the refinery process may change the size of the hydrocarbon molecule. Catalytic cracking involves the use of a catalyst to break or "crack" larger oil molecules into smaller molecules suitable for use in final products such as gasoline. Cracked materials may be used as feedstocks to other refinery processes such as the reforming process mentioned above.

However, the overall refining process is not a static one. Market forces make demands both on the products required of the refinery and also define the types of crude oils available as feedstocks to the refinery. Over the past dozen years, various conservation measures have cut into the amount of gasoline needed in the marketplace. The requirement in the U.S. that lead compounds be substantially removed from gasoline sold for use in automobiles has caused similar massive changes in the way gasoline is produced. The decreasing availability of so-called "light" crude oils, those which typically contain less tar-like materials and sulfur-bearing compounds, has led to the major redesign of many refineries in the U.S. to allow use of the more-available heavier oils.

The use of heavier oils has had several immediate and clear consequences in the overall refinery process. First of all, the heavier oils contain contaminants present to a substantially smaller degree in the lighter oils. These materials include sulfur and nitrogen compounds as well as additional metal-bearing compounds such as the nickel and vanadium contaminants removed by the present invention. Obviously and also as a result of the heavy crude use is the increased emphasis on refinery processes which convert heavier hydrocarbons to smaller and more useful ones. An added complicating factor is that a substantial number of the additional contaminants are harmful to the catalysts used in the now more important conversion processes.

The metal vanadium, in particular, tends to deposit on the catalytic cracking catalyst and tends both to increase the production of coke which coats portions of the catalyst rendering it less useful and of hydrogen which is not generally seen as a useful end product. Vanadium also attacks the cracking catalyst itself, in particular the active zeolite portion of the catalyst, apparently as a migrating vanadium oxide material.

Both nickel and vanadium-bearing compounds are additionally undesirable if left in the refinery products which are separated, or distilled, from crude feedstocks. Fuel oils containing these metals are very harmful to fired boilers. The vanadium and nickel compounds create corrosive and persistent deposits in the cool ends of the boilers. The deposits often must be removed by hand.

In any event, processes which remove the nickel and vanadium compounds present in crude oils (or its various fractions) are clearly becoming more desirable.

The methods used in the past included one in which the oil was treated with a non-oxidizing acid such as hydrogen chloride. The metals in the oil precipitated in the form of an "acid sludge". The treated oil was then separated from the sludge, neutralized and fractionated to remove lower boiling constituents. The remaining fraction containing quantities of nickel and vanadium was then catalytically cracked and the spent catalyst (containing large concentrations of nickel and vanadium) was demetallized by extraction before being recycled to the cracking stage.

The metals in many of the heavier oil fractions have been found to be present in the form of low molecular weight chelates, particularly as metalloporphyrins. It is said that these metals may be removed by extraction with physical solvents such as gammabutyrolactone, acetonitrile, phenol, furfural, 2-pyrrolidinones, dimethyl sulfoxide, dimethylformamide, and pyridine-water mixtures. Gammabutyrolactone is said to be the best among these prior art solvents in respect to selectivity for vanadium and nickel. See, U.S. Pat. No. 2,913,394 by C. N. Kimberlin and W. J. Mattox.

The present invention is, however, concerned with the use of certain polar solvents which are superior to gammabutyrolactone when used as solvents for extraction of vanadium and nickel metalloporphyrinic compounds from oils.

Among the solvents which are suitable for such a use are ethylene carbonate, propylene carbonate, ethylene thiocarbonate and dimethyl sulfone. Certain of these solvents, of course, have other uses.

As is shown in U.S. Pat. No. 4,348,314, ethylene carbonate is used as a specialty solvent for polymers. As is further shown in U.S. Pat. No. 3,018,228, it has also been used for aromatics extraction and the synthesis of pharmaceuticals. U.S. Pat. No. 3,912,801 discloses the extraction of a number of metal-bearing compounds from acid aqueous media using an alkylene carbonate.

None of the known prior art shows a process for the separation of nickel and/or vanadium bearing metalloporphyrinic compounds from oils by using the solvents selected in the manner specified below.

SUMMARY OF THE INVENTION

The present invention is a method for extracting vanadium and/or nickel-containing materials from oils containing those materials. The solvent used is one or more generically having a selected range of solubility parameter components. The components consist of $\delta_d$, the component arising from dispersion forces; $\delta_p$, the component arising from dipole coupling forces or polarity; and $\delta_h$, the component arising from hydrogen bonding forces. The ranges of solubility parameter components are 8.7 to 10.0 for $\delta_d$; 8.6 to 10.7 for $\delta_p$; and 0 to 6 for $\delta_h$. Specifically preferred solvents are ethylene carbonate, propylene carbonate, ethylene trithiocarbonate and dimethyl sulfone.

These solvents are contacted with an oil containing the nickel- or vanadium-containing materials. Two phases are formed; a lower solvent extract phase containing the vanadium and nickel compounds (usually in the form of the metalloporphyrin) and an upper less dense oil phase substantially depleted in vanadium and nickel. The two phases are then separated.

The weight ratio of liquid solvent to oil should be at least 0.1:1 and the extraction is preferably carried out at elevated temperatures, that is, between 80° C. and 200° C. Dimethyl sulfone exists as a solid between 80° C. and 110° C. and therefore the extraction is carried out at temperatures greater than 110° C. when using it as the solvent.

DETAILED DESCRIPTION OF THE INVENTION

As noted above, this invention is a process for extracting nickel and/or vanadium metalloporphyrinic containing materials from oils by solvent extraction with materials having the solubility parameter components outlined below.

According to liquid solution theory, the free energy of a solute is at its smallest value in a solution having a like solubility parameter. The solubility parameter is the cohesive energy density of the solution, and is defined by the square root of the ratio of the energy of vaporization and the molar volume as shown by Equation (1);

$$\delta = \sqrt{\frac{E_{vap}}{V_m}} \quad (1)$$

The unit of the solubility parameter is $(cal/cm^3)^{\frac{1}{2}}$ and is determined at room temperature. The solubility parameter may be expressed as the sum of several individual contributions or "components". These components arise from dispersion forces ($\delta_d$), dipole coupling forces or polarity ($\delta_p$), and hydrogen bonding forces ($\delta_h$) between solution molecules. The sum of the squares of these three components is equal to the square of the overall solubility parameter $\delta$ as indicated in Equation (2):

$$\delta^2 = \delta_d^2 + \delta_p^2 + \delta_h^2 \quad (2)$$

Solubility parameters may be found by consulting published tables or by following standardized procedures. See, C. Hansen and A. Beerhower, Kirk-Othmer Encyclopedia of Chemical Technology, 2nd Edition, Suppl. pp. 889–910. The dispersive component, $\delta_d$, can be determined by the solubility parameter of a solvent's homolog, i.e., in a hetero-organic solvent by a corresponding molecule with carbon replacing the heteroatoms. The dipole component, $\delta_p$, is measured from the dielectric constant and the index of refraction of the solvent. The correct overall component may be determined from vapor pressure-temperature data. The hydrogen bonding solubility parameter is obtained by difference by substituting the values of the individual components in Equation (2).

Each of the three-dimensional solubility parameters components $\delta_d$, $\delta_p$, and $\delta_h$, may be determined for a particular solvent candidate for the extraction of vanadium and nickel from oils. If the solvent has a $\delta_p$ of from 8.6 to 10.7, a $\delta_d$ of from 8.7 to 10.0 and a $\delta_h$ of from 0.0 to 6.0, it is considered a superior solvent for the extraction at temperatures of between 80° C. and 200° C. Solvents such as gammabutyrolactone, furfuraldehyde, dimethyl sulfoxide, dimethyl formamide, acetonitrile and 2-pyrrolidone, which have heretofore been described as good solvents for vanadium and nickel extraction, however, all show solubility parameters which fall outside these ranges.

It has been found that temperature is an important factor in the determination of the optimum three-dimensional solubility parameter. For example, gammabutyrolactone which has been known in the art as a good extraction solvent for the extraction of vanadium and nickel from oils containing them shows a marked decrease in selectivity for vanadyl porphyrins as the temperature increases, and the values of the individual solubility parameter components for gammabutyrolactone also fall outside the range of values for such components according to the invention. The selectivity of ethylene carbonate, on the other hand, which is a solvent which meets the solubility criteria herein, shows little decrease in selectivity with temperature.

Several liquid extraction solvents which may be used in this invention are ethylene carbonate, propylene carbonate, ethylene trithiocarbonate and dimethyl sulfone. All show higher selectivity for vanadyl porphyrins than for the other components found in oils.

Ethylene carbonate, the preferred polar solvent herein, has the chemical formula $C_3H_4O_3$ and the chemical structure:

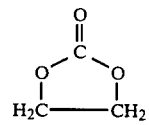

It has certain physical properties which make it a good extraction solvent in that it has relatively high boiling point (238° C.), and a high density, 1.32 g/cc which allows rapid settling during extraction. Because of the differences in density between the solvent and oil, the settling should be quick and complete in almost any extraction equipment.

Regeneration of the solvent may be effected by distillation, by cooling or by the addition of water or other antisolvent to remove the metallic component from the solvent.

The oil and solvent may be contacted by employing counter-current extraction techniques known in the art. Generally the weight ratio of solvent to oil should be at least 0.1:1 and preferably at least 1:1. The solvent, being more dense, separates as a lower phase with the oil forming the upper phase. The extraction should be conducted at elevated temperatures, preferably between about 80° C. and about 200° C. Since dimethyl sulfone has a melting point of 110° C. temperatures between about 110° C. and 200° C. should be employed when it is used as the extraction solvent. By employing ethylene carbonate as the extraction solvent there is also less solubilization of oil than with gammabutyrolactone and ethylene carbonate shows better selectivity than gammabutyrolactone.

The oils upon which this invention may be practiced include, of course, any oil which contains the offending metal contaminants. Practically speaking, however, to limit the volume of oil treated in a particular refinery, the process need be practiced only on the heavier streams. The metal-containing compounds are generally concentrated in those streams. They include those oils identified by the generally accepted nomenclature of atmospheric residual oil (atmospheric resid), vacuum residual oil (vacuum resid), deasphalted oil (DAO), vacuum gas oil (VGO), and the like. Certain crude oils represent special problems during refining and the distillation residues of these crudes are known by special acronyms, e.g., heavy Arabian atmospheric residual oil (HAR) and heavy Arabian vacuum residual oil (HAVR).

In order to more fully describe the invention, the following examples are given. These examples are intended to be only illustrative and in no way limiting of the invention.

EXAMPLE 1

This Example demonstrates that in comparisons of the porphyrin distribution coefficients of many candidate solvents for the extraction of vanadium and nickel from heavy oils, including known solvents for the extraction, there are no obvious correlations between solvent structure and performance.

Vanadyl porphyrins were isolated from Cold Lake Crude by extraction with acetonitrile followed by chromatography on silica gel. The vanadyl porphyrin fraction eluted with dichloromethane. This fraction was dried down and redissolved in cyclohexane at about $10^{-5}$ M (0.7 ppm Vanadium). The cyclohexane solution was contacted with an equal volume of an immiscible polar solvent and thoroughly shaken. After settling overnight, the two phases were sampled spectroscopically. The concentration of vanadyl porphyrin was measured by the Soret absorbance. The ratio of the concentration in the polar phase to that in the cyclohexane phase is the distribution coefficient. The results follow in Table 1.

TABLE 1

| Solvent | Porphyrin Distribution Coefficient |
|---|---|
| Methanol | .46 |
| Monoethanolamine | .26 |
| Formamide | .06 |
| Acetonitrile | 1.20 |
| Dimethylsulfoxide | 11.20 |
| N—Methylformamide | 3.75 |
| Ethylene glycol | .06 |
| Ethylene Diamine | 3.10 |

TABLE 1-continued

| Solvent | Porphyrin Distribution Coefficient |
|---|---|
| N,N—Dimethylformamide | 5.50 |
| N,N—Dimethylthioformamide | 15.00 |
| N,N—Dimethylacetamide | 3.40 |
| Gammabutyrolactone | 24.00 |
| 2-pyrrolidinone | 14.10 |
| Furfuraldehyde | 34.50 |
| Aniline | 4.00 |

Inspection of this list shows no obvious correlations between molecule structure or composition of the prior art solvents, 2-pyrrolidinone, gammabutyrolactone, and furfuraldehyde and the distribution coefficient. All performed acceptably. Solvents which are known to be very polar, such as formamide, ethylene glycol, and methanol, tend to have low distribution coefficients and obviously perform poorly as extraction solvents for vanadium and nickel.

The solubility parameter components of the above solvents as well as ethylene carbonate, propylene carbonate and dimethyl sulfone were then considered. Only ethylene carbonate, propylene carbonate and dimethyl sulfone met the criteria: $\delta h \leqq 6$, $\delta_p$ between 8.6 to 10.7 and, $\delta_d$ 8.7 to 10.0.

The solvents had the following solubility parameter components.

| Solvent | $\delta_d$ | $\delta_p$ | $\delta_h$ |
|---|---|---|---|
| Ethylene Carbonate | 9.5 | 10.6 | 2.5 |
| Propylene Carbonate | 9.8 | 8.8 | 2.0 |
| Dimethyl Sulfone | 9.3 | 9.5 | 6.0 |
| Ethylene Trithiocarbonate | — | — | — |

EXAMPLE 2

In this Example, the temperature dependence of the distribution coefficients for oil components was determined for physical solvent extraction of Heavy Arab Vacuum Resid (HAVR) boiling between 950°-1250° F. using solvents of this invention. In this Example, a distillate of HAVR containing about 36 ppm vanadium and about 4.6 ppm nickel was contacted at a 1:1 (w/w) treat ratio with each of ethylene carbonate, propylene carbonate, ethylene trithiocarbonate, and dimethyl sulfone as well as gammabutyrolactone (for comparison) in separate experiments in a separatory device to form separable top and bottom phases. Small aliquots were removed from both top and bottom phases at different temperatures varying from about 80° C. to 200° C., the top phase containing solvent extracted metalloporphyrins.

All solvents showed higher selectivity for metalloporphyrins including vanadium and nickel metalloporphyrins than other oil components. Distribution coefficients increased in the following order: Saturates < 1-2 Ring Aromatics ≦ 3-5 Ring Aromatics ≦ 5-6 Ring Aromatics ≦ 6-7 Ring Aromatics ≦ Polars < Vanadyl porphyrins.

The ratio of the distribution coefficient for vanadyl porphyrins to that for 1-2 Ring Aromatics was calculated for each solvent as one quantitative measure of Selectivity. When compared at 150° C. these solvents exhibited the following order of selectivity: gammabutyrolactone < propylene carbonate = dimethyl sulfone<ethylene trithiocarbonate<ethylene carbonate.

The selectivities of the solvents are given below.

| Selectivity for Vanadyl Porphyrins vs. 1-2 Ring Aromatics | | | | | | |
|---|---|---|---|---|---|---|
| | Temperature (°C.) | | | | | |
| Solvent | 75 | 100 | 125 | 150 | 175 | 200 |
| Gammabutyrolactone | 54 | 28 | 16 | 18 | 3 | 1.0 |
| Ethylene Carbonate | 52 | 48 | 45 | 42 | 40 | 36 |
| Propylene Carbonate | 36 | 34 | 30 | 20 | 16 | 13 |
| Dimethyl Sulfone | —* | —* | 17 | 21 | 40 | 1.0 |
| Ethylene Trithiocarbonate | — | 42 | 31 | 29 | 11 | — |

*MP = 110° C.

EXAMPLE 3

This Example demonstrates that ethylene carbonate used as an extraction solvent for the 950-1250° F. fraction of HAVR dramatically reduces the vanadium and nickel concentrations therein.

The 950-1250° F. fraction of HAVR containing about 36 ppm vanadium and about 4.6 ppm nickel present as organic chelates was contacted with ehtylene carbonate at a 1:1 (w/w) treat ratio. The bottom extract phase was drawn off and the same initial weight of fresh solvent was added. This was repeated seven times. The seven extract phases and the raffinate oil were dried in a vacuum oven to determine loadings. Analysis for vanadium was done by visible light spectroscopy. The reslts are shown in the table below.

| Extract Number | Vanadium in Raffinate = $V_{raff.}$ (ppm) | Vanadium in Extracted Oil = $V_{ext.}$ (ppm) | $V_{ext.}/V_{raff.}$ | Extract Yield (wt. %) |
|---|---|---|---|---|
| 1 | 21 | 292 | 13.9 | 3.51 |
| 2 | 12 | 171 | 14.2 | 3.92 |
| 3 | 7.5 | 119 | 15.9 | 3.19 |
| 4 | 5.5 | 78 | 14.2 | 3.25 |
| 5 | 3.75 | 43 | 11.5 | 3.37 |
| 6 | 3.35 | 39 | 11.6 | 2.08 |
| 7 | 2.2 | 30 | 13.6 | 1.65 |
| | (Ni = 0.5) | | | - |
| overall | 2.2 | 125 | 57 | 20.9 |

The total vanadium was reduced from 36 to 2.2 ppm or 93.8%. The nickel was reduced from 4.6 to 0.5 ppm or 89%. The mass balance for the experiment was 102%. The raffinate yield was 79%. The separation also reduced the microcarbon residue of the oil from 8 to 5.8 according to Micro Conradson Carbon Residue (MCR) test. The MCR of the first extracted oil was 18.

The selectivity of the extraction may be quantitatively measured by the separation factor. The separation factor is defined as $\alpha$ where:

$$\alpha = \frac{\text{oil wt. in raffinate phase}}{\text{oil wt. in extract phase}} \cdot \frac{\text{metal wt. in extract phase}}{\text{metal wt. in raffinate phase}}$$

The separation factor was measured for each successive extraction and was found to average 16.5.

EXAMPLE 4

An extended vacuum gas oil from Heavy Arab Vacuum Resid (HAVR) which boiled in the atmosphere equivalent range 950-1289° F. was extracted with gammabutyrolactone and with solvents of the present invention to determine how the various components of the oil distributed between between the immiscible phases. The vacuum gas oil was contacted with an equal volume of the following polar solvents in separate experiments at 95° C.; gammabutyrolactone, ethylene carbonate, propylene carbonate, and ethylene trithiocarbonate. After thorough mixing and settling overnight the two phases were sampled. The concentration of vanadyl porphyrin in each phase was measured from the Soret absorbance. The concentration of 1-2 Ring Aromatics in each phase was measured by High Pressure Liquid Chromatography (HPLC). The ratio of the metalloporphyrin concentration in the polar solvent phase to that in the oil phase is the "Vanadyl Porphyrin Distribution Coefficient". The Selectivity is the ratio of the Distribution Coefficient for vanadyl to the Distribution Coefficient for 1-2 Ring Aromatics. The vanadyl Distribution Coefficient for each solvent and the Selectivity of VOP against 1-2 Ring Aromatics in the oil at 95° C. is set forth in the Table below.

| Solvent | Vanadyl Porphyrin Distribution Coefficient | Selectivity of Vanadyl Porphyrin vs. 1-2 Ring Aromatics |
|---|---|---|
| Gammabutyrolactone | 1.9 | 29 |
| Ethylene Carbonate | 0.3 | 48 |
| Propylene Carbonate | 0.6 | 33 |
| Ethylene Trithiocarbonate | 2.2 | 31 |

Ethylene carbonate, propylene carbonate, and ethylene trithiocarbonate each slow higher selectivity than gammabutyrolactone even though their vanadyl Distribution Coefficients may not be as high as 95° C.

EXAMPLE 5

This Example demonstrates that ethylene carbonate solubilizes considerably less oil than the well known extraction solvent gammabutyrolactone and is more selective than gammabutyrolactone.

The 950-1250° F. fraction of HAVR was extracted with three sequential portions each of ethylene carbonate at 80° C. at a ratio of HAVR fraction to solvent of 1:2 (w/w). The results of vanadium removal and raffinate yield are given in Table III.

TABLE III

| Solvent | % V Removal | Raffinate Yield |
|---|---|---|
| Gammabutyrolactone | 97 | 60 |
| Ethylene carbonate | 47 | 95 |

Having thus described the invention and provided examples showing the use of the invention, it should be apparent to those having ordinary skill in this art that variations exist in the process of using the invention. These variations would be within the spirit of the invention as outlined by the claims expressed below.

I claim as my invention:

1. A method for the extraction of vanadium or nickel metalloporphyrinic compounds from hydrocarbon oil containing such compounds comprising the step of contacting said oil with a solvent having a $\delta_h$ of between 0 and 6, a $\delta_p$ of between 8.6 and 10.7 and a $\delta_d$ of between 8.7 and 10.00.

2. The method of claim 1 wherein said contacting is conducted at temperatures between 80° C. and 200 ° C.

3. The method of claim 1 wherein said solvent is one or more selected from the group consisting of ethylene carbonate, propylene carbonate, ethylene trithiocarbonate and dimethyl sulfone.

4. The method of claim 1 wherein said oil is a deasphalted oil.

5. The method of claim 1 wherein said oil is a vacuum gas oil.

6. The method of claim 1 wherein the weight ratio of said solvent to said vanadium or nickel-containing oil is at least about 0.1:1.

7. A method for the extraction of vanadium or nickel metalloporphyrinic compounds from hydrocarbon oil containing those compounds comprising the step of contacting sail oil with ethylene carbonate wherein the weight ratio of ethylene carbonate to said oil is at least about 0.1:1 at temperatures between 80° C. and 200° C.

8. A method for the extraction of vanadium or nickel metalloporphyrinic compounds from hydrocarbon oil containing those compounds comprising the step of contacting said oil with propylene carbonate wherein the weight ratio of propylene carbonate to said oil is at least about 0.1:1.0 at temperatures between 80° C. and 200° C.

9. A method for the extraction of vanadium or nickel metalloporphyrinic compounds from hydrocarbon oil containing those compounds comprising contacting said oil with ethylene trithiocarbonate wherein the weight ratio of ethylene trithiocarbonate to said oil is at least about 0.1:1.0 at temperatures between about 80° C. and 200° C.

10. A method for the extraction of vanadium or nickel metalloporphyrinic compounds from hydrocarbon oil containing those compounds comprising contacting said oil with dimethyl sulfone wherein the weight ratio of dimethyl sulfone to said oil is at least about 0.1:1.0 at temperatures between about 110° C. and 200° C.

* * * * *